United States Patent [19]

Dauser, Jr.

[11] 4,013,332

[45] Mar. 22, 1977

[54] ELECTRICAL CONNECTOR

[75] Inventor: William C. Dauser, Jr., North Muskegon, Mich.

[73] Assignee: Lloyd A. Heneveld, trustee, Grand Rapids, Mich.

[22] Filed: June 30, 1975

[21] Appl. No.: 591,490

[52] U.S. Cl. ..... 339/98

[51] Int. Cl.[2] ..... H01R 9/08

[58] Field of Search ..... 339/95, 97–99

[56] References Cited

UNITED STATES PATENTS

| | | | |
|---|---|---|---|
| 2,501,187 | 3/1950 | Oortoijsen | 339/95 R |
| 2,738,479 | 3/1956 | Gibson | 339/98 |
| 3,644,875 | 2/1972 | O'Loughlin | 339/97 R |
| 3,790,918 | 2/1974 | Dauser | 339/97 R |
| 3,812,449 | 5/1974 | Elm | 339/98 |
| 3,820,058 | 6/1974 | Friend | 339/99 R |
| 3,880,489 | 4/1975 | Dauser, Jr. | 339/98 |

*Primary Examiner*—Joseph H. McGlynn

*Attorney, Agent, or Firm*—Price, Heneveld, Huizenga & Cooper

[57] ABSTRACT

A solderless electrical connector assembly includes a base portion formed of an insulating material having wire positioning means for receiving a conductive element and connector positioning means for receiving a connector member. The connector member is of a conductive material and includes two legs having conductor engaging means. The connector positioning means is oriented so the angle between the axis of the conductor positioning means and a line between the two legs of the connector is less than 90° thereby spacing the legs of the connector along the axis of the conductor. When secured together, the base cooperates with the connector member and the conductive element to deform any insulation from the conductive element and to make positive electrical contact between the connector member and the conductive element.

27 Claims, 16 Drawing Figures

ELECTRICAL CONNECTOR

BACKGROUND OF THE INVENTION

This invention relates to electrical connectors and more particularly, to solderless electrical connectors such as those used for splicing insulated conductors in telephone and other electrical circuits. Connectors heretofore used for splicing and connecting in electrical circuits generally utilize special thermal blocks in which the wires are positioned. Special tools are required to secure the block and wires together. To eliminate the possibility of damage from moisture, humidity, and the like, the terminal block is sealed with plastic sleeving or other plastic-like materials to form a weather tight unit. Changes to the circuit and correction of errors are virtually impossible without complete destruction of the connection and usually with destruction of the circuit.

Other techniques also utilized, include individual splicing members in the form of sleeves or the like which are positioned and crimped over the stripped ends of the wire conductors. Special crimping tools are required to fasten the sleeve to the wire ends to form the connection. Additionally, joining different size wire presents difficulties because different size sleeves may be required and the crimping tool may not secure all different sizes of wire with sufficient force. Still other connectors have been utilized wherein a formed connector member including a rigid, slotted plate forms a plurality of rigid jaws in which, when installed, the jaws cut through the insulation and deform the wire conductor. When disconnected, the deformed area of the conductor in which the connection is made may break thereby resulting in destruction of service.

The connectors above described are relatively complex in their construction and in their use and as a result are expensive either in the original cost or in their utilization because of the special tools required.

These objections have been overcome to some degree by U.S. Pat. No. 3,880,489 issued to the inventor of this invention on Apr. 29, 1975 which teaches a connector base which positions wires for engagement by a conductive connector supported within an insulating connector support. The connector assembly taught by the patent requires three members, the base, the conductive connector and the connector support, to form an electrical connection with a wire. Further, either the conductive connector or the connector support must be sufficiently resilient so a compressive force is exerted on the conductor by the conductive connector. Typically, the electrical connector assembly is adapted for use with one size of wire. Additionally, the patent teaches insulation stripping and wire engaging using a flat face of the conductive connector. Fabrication of a connector assembly in accordance with this patent requires formation of three separate components having certain resiliencies and resistances to deformation. Also, stripping insulation with a flat surface requires a certain minimum applied abrasive force.

SUMMARY OF THE INVENTION

The present invention can conductively engage a multiplicity of conductors of widely varying wire gauges in a single connector. The invention also simplifies the construction of an electrical connector, reduces the number of components of the connector and improves the electrical quality of the connection that is made. The invention in one embodiment uses a corner and adjacent faces of a leg to strip away insulation and engage the conducting wire. An angular corner more readily strips insulation than a flat face. Further, to make a single connection between a plurality of wires only two components are required, the base element and the conductive connector. The base element is adapted so no portion of the connector need be a resilient material of a high elasticity because the base member provides a force pressing the connector against the conductor. Additionally, advantage is taken of the elasticity of the conductor itself. By using a connector having two legs, one leg being offset from the other in a direction along the axis of the conductor, the push of each leg is resisted by the elasticity of the wire as well as the configuration of the base preventing lateral movement of the connector and the electrical conductor.

In accordance with an embodiment of this invention, an electrical connector assembly has a base member with means for receiving conductors and means for receiving a connector having two legs. In one embodiment of this invention, the conductor positioning means are openings having parallel axes aligned in a plane. The two legs of the connector are inserted into receiving means having openings which are parallel to the plane in which the conductors are aligned and are spaced so the two legs of the connector straddle the conductors. The two openings are not directly opposite each other with respect to the axes of the conductors but are offset in a direction along the axes from each other. The conductor diameter sizes need not be all the same because the connector receiving means can guide the legs of the connector partly through and partly around larger conductors in appropriately larger conductor receiving means and guide the legs of the connector to apply pressure to a subsequent smaller diameter conductor. In another embodiment of this invention, the axes of the conductors are not parallel but crisscross along a line between and parallel to the legs of the connector. Connection between the conductors and the connector is made adjacent that line.

DETAILED DESCRIPTION

Figure 15:
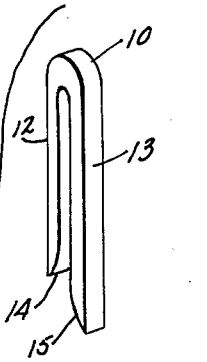
FIG. 15 is an exploded perspective view of an electrical connector assembly having a base, a connector and wires to be electrically connected in accordance with an embodiment of the invention.
Figure 15:
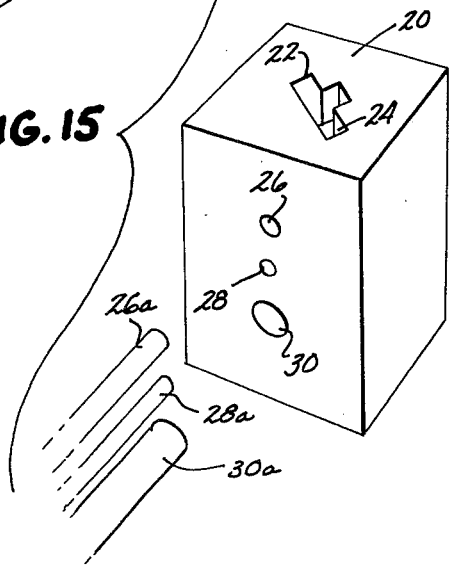

Referring to the drawings, FIG. 15 shows an exploded perspective view of a conductor engaging connector 10 which is configured and aligned to be inserted into a base member 20 through connector positioning slots 22 and 24. Base member 20 also has conductor positioning openings 26, 28 and 30 having their axes aligned in the same plane and passing partly between and partly through connector positioning slots 22 and 24. Conductors 26*a*, 28*a* and 30*a* are aligned to be inserted into conductor positioning openings 26, 28 and 30, respectively. Conductors 26*a*, 28*a* and 30*a* can be of the same wire size, or, as shown in FIG. 15, can be of different sizes. In either case, the connector assembly including connector 10 and base member 20 can cooperate to electrically connect wires 26*a*, 28*a* and 30*a* to each other. The two legs are spaced from each along the axis of a conductor positioning means. Accordingly, each leg can, if desired, intersect more than half the cross section of a conductor positioning opening without cutting a conductor in the opening into two pieces. Although each leg can intersect less than half of the cross section of the conductor positioning means, intersecting at least half of the cross section is advantageous because then no conductor will be too thin to be engaged by the connector.

Figure 1:
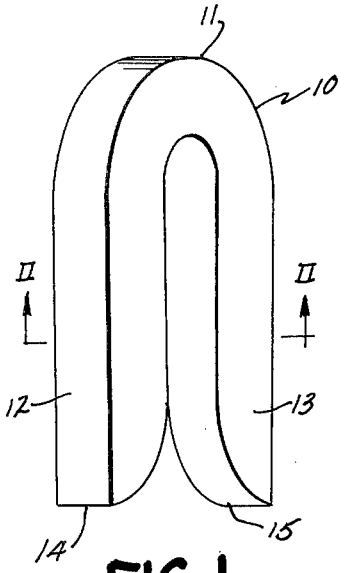
FIG. 1 is a perspective view of a conductor engaging connector formed from a wire in accordance with an embodiment of this invention.
Figure 1A:
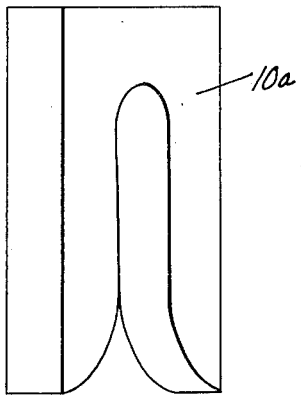
FIG. 1A is a perspective view of a conductor engaging connector stamped from sheet metal in accordance with an embodiment of this invention.

Connector 10 has a U-shaped junction area 11 connecting legs 12 and 13 having pointed ends 14 and 15, respectively. Legs 12 and 13 of connector 10 are rounded outwardly from the center of connector 10 to form points 14 and 15. Connector 10 can be formed from a wire stock having a rectangular cross section and bent at junction area 11. FIG. 1A shows as an alternative embodiment a connector 10*a* which is stamped from sheet metal and has a slightly squared off U-shaped junction area. Connector 10 has an engaging means along the length of its leg for contacting a conductor. As shown in FIG. 1, the engaging means is the corner at the junction of two flat faces. Alternative engaging means include serrated edges along the length of the legs formed by either notching the legs or twisting the legs about their longitudinal axis.

Figure 2:
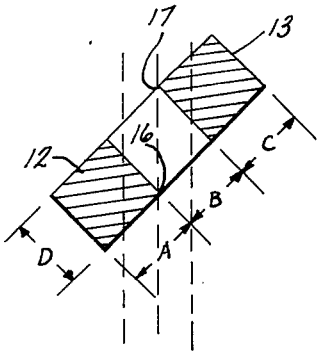
FIG. 2 is a cross-sectional view taken along section line II—II of FIG. 1.

FIG. 2 shows a cross sectional view of legs 12 and 13 of connector 10 which as shown has an overall cross-sectional outline which is elongated in shape which as disclosed in FIGS. 5, 6, 7 and 15 conform to the overall cross-sectional elongated shape of the combined connector positioning slots 22 and 24. Dimensions A and C represent the side widths of legs 12 and 13, respectively, dimension D representing the width of leg 12 opposite leg 13 and dimension B representing the distance between legs 12 and 13. Advantageously, dimensions B and D are equal so a good connection can be made when connector 10 is forced around a wire conductor. However, because of specific design considerations such as extremely small conductors, or extremely large bare conductors, it may be desirable to alter either the spacing B or the width D. The dimensions A and C are advantageously equal, but may also be altered to satisfy sliding conditions or other design criteria. A dotted line connecting diagonally opposed corners 16 and 17 of leg 12 and leg 13, respectively, indicates the center line of a conductor positioning opening. Corners 16 and 17 penetrate through any insulation surrounding the conductor and exert a force on the conductive portion of the conductor thereby providing a good electrical contact. Considerations in forming a good electrical contact include having the connector legs a sliding fit in the connector positioning slots, locating the contacting corners near the center line of the conductor positioning openings, and having the outer diameter of the conductor be a relatively close fit with the conductor positioning openings.

Figure 4:
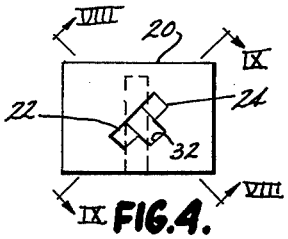
FIG. 4 is a plan view of a base member in accordance with an embodiment of this invention.
Figure 5:
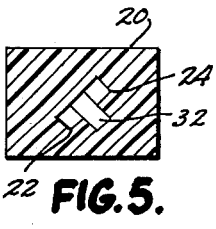
FIG. 5 is a cross-sectional view along section line V—V of FIG. 3.
Figure 6:
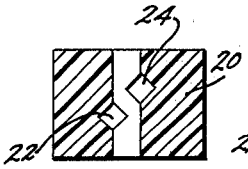
FIG. 6 is a cross-sectional view along section line VI—VI of FIG. 3.
Figure 7:
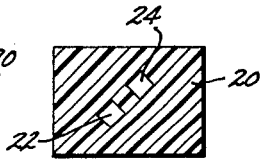
FIG. 7 is a cross-sectional view along section line VII—VII of FIG. 3.
Figure 3:
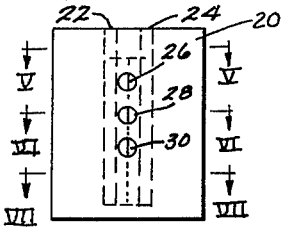
FIG. 3 is a frontal elevation view of a base member in accordance with an embodiment of this invention.
Figure 8:
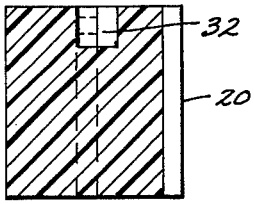
FIG. 8 is a cross-sectional view along section line VIII—VIII of FIG. 4.
Figure 9:
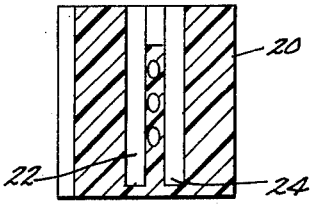
FIG. 9 is a cross-sectional view along section line IX—IX of FIG. 4.
Figure 10:
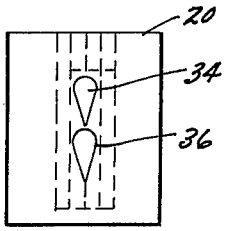
FIG. 10 is a frontal elevation view of a base member in accordance with an embodiment of this invention.

Referring to FIG. 3, connector positioning slots 22 and 24 are adapted to receive legs 12 and 13 of connector 10 and are generally rectangular in cross section. Conductor positioning openings 26, 28 and 30 are positioned to intersect openings 22 and 24 so when a conductor is placed in a conductor positioning opening and connector 10 is inserted, corners 16 and 17 of connector 10 will contact the conductor inserted into the opening. FIG. 4 shows a relatively shallow depression 32 between the ends of openings 22 and 24 for inserting a retracting tool such as, for example, a small screwdriver, under U-shape junction area 11 of connector 10 to facilitate removal of plug 10 from base member 20. FIGS. 5–9 show various cross sections of base member 20. FIG. 10 shows an alternative embodiment of base 20 having teardrop shape conductor positioning openings 34 and 36. A conductor having a larger diameter would go in the upper larger portion of the teardrop and a conductor having a smaller diameter would be wedged into the bottom tapering part of teardrop shaped openings 34 or 36. The insertion of legs 12 and 13 of connector 10 would force the conductor to be wedged against the narrowest part of the teardrop shaped opening which can accommodate the conductor. The teardrop shape opening is advantageous because it can accommodate more than just one size of conductor.

Figure 13:
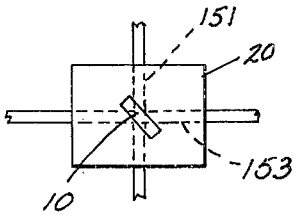
FIG. 13 is a plan view of a base member with the addition of crossing conductors in accordance with an embodiment of this invention.

FIG. 13 shows an alternative embodiment of base 20 having conductor positioning openings 151 and 153 intersecting between the legs of connector 10. As shown, the conductors in openings 151 and 153 are at right angles to each other and connector 10 is at a 45° angle to the conductors. This configuration is particularly desirable when there is a common conductor or bus to a plurality of connector assemblies with each assembly having a plurality of conductors to be connected to the bus.

Figure 14:
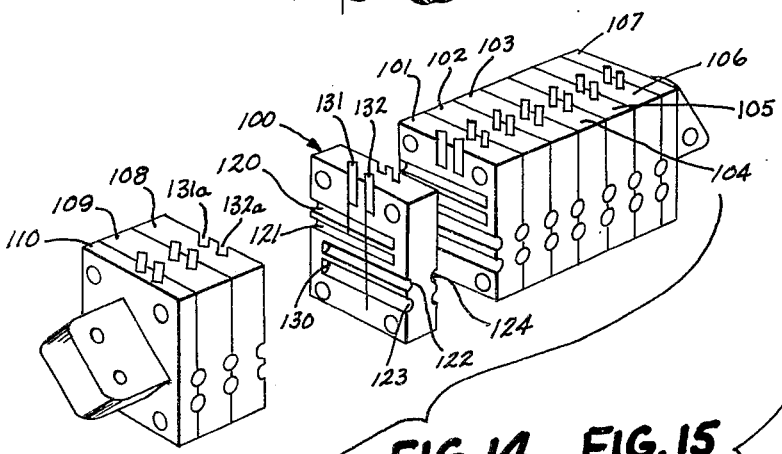
FIG. 14 is a perspective view of a modular base comprised of segments in accordance with an embodiment of this invention.

FIG. 14 shows a perspective view of modular base member segments 100–110 which are joined together to form a base member adapted for receiving a plurality of connectors and conductors. For example, segment 100 has a concave surface for each conductor receiving opening. A first side of segment 100 has semi-circular concave openings 120, 121, 122 and 123. The other side of segment 100 has concave openings 124 and 125. Other openings on the other side of segment 100 are not visible but correspond to openings 120 and 121. If two such segments are placed side by side then the two concave portions act to make one cylindrical opening for the insertion of a conductor. The conductor can be pushed in until it reaches the end of the opening and is stopped by a wall such as abutment 130. Segment 100 also contains holes for one leg of a connector 10. For example, a leg receiving opening 131 extends through and intersects concave openings 120 and 121. A leg receiving opening 131*a* to act in conjunction with opening 131 to receive the legs of a connector is located in segment 108. A leg opening 132 extends and intersects concave openings 120, 121, 122 and 123. A leg receiving opening 132*a* to act in conjunction with opening 132 to receive the legs of a connector is located in segment 108.

OPERATION

Figure 11:
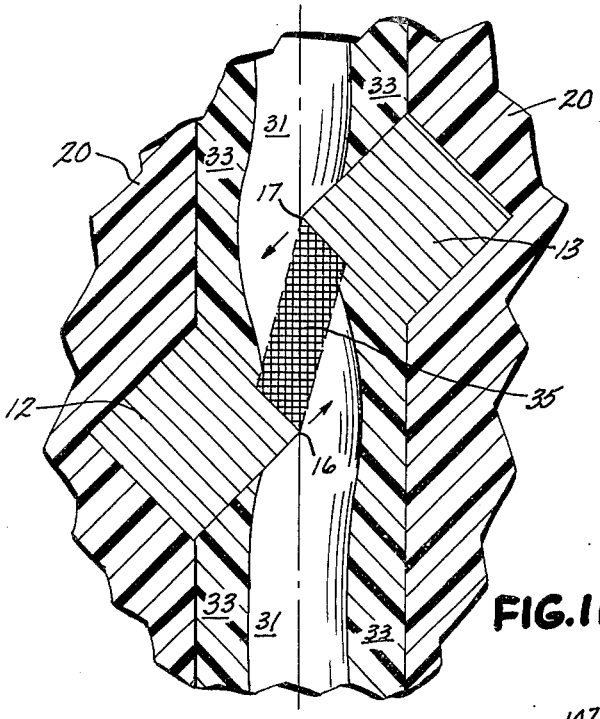
FIG. 11 is a partial cross-sectional view as in FIG. 6 with the addition of a conductor in accordance with an embodiment of this invention.
Figure 12:
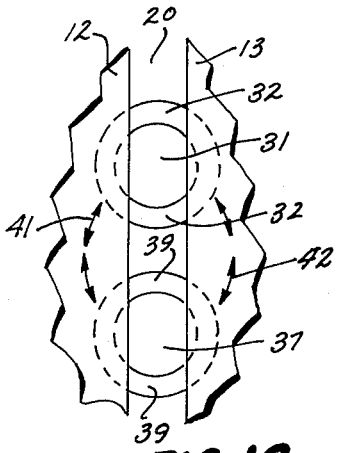
FIG. 12 is a partial cross-sectional view as in FIG. 9 with the addition of conductors in accordance with an embodiment of this invention.

When inserting connector 10 contact successive conductors inserted in conductor receiving openings 26, 28 and 30 of base member 20, the curved sections on the bottoms of connector 10 with points 14 and 15 successively pierce the insulation of the conductor and wedge into the conductor, slightly displacing it, and compressing a portion of the conductor between legs 12 and 13 of connector 10. Referring to FIGS. 11 and 12, a conductor 31 having insulation 33 is shown contacted by legs 12 and 13. The area of compression between legs 12 and 13 on conductor 31 is shown as cross hatched area 35. Contact between legs 12 and 13 and conductor 31 is provided by pressure of legs 12 and 13 on conductive portion 31 because legs 12 and 13 are braced by base member 20 and because of the elasticity of conductor 31 and insulation 33 resisting the deflection and deformation force of legs 12 and 13 on the conductor. Further, there is a compressive force by base member 20 on insulation 33 and conductive portion 31 resisting their deflection and further applying force to the electrical connection between legs 12 and 13 and conductor 31.

FIG. 12 shows a cross-sectional view in which an additional conductor 37 having insulation 39 is also contacted by legs 12 and 13. The current paths between conductors 31 and 37 are shown by arrows 41 in leg 12 and arrows 42 in leg 13. Because there are two paths connecting conductors 31 and 37 the resistance is halved from what it would be if there were only one connection between conductors 31 and 37. When connector 10 has reached the bottom of its travel in openings 22 and 24, a slight relaxation of that portion of the conductor between legs 12 and 13 takes place, but the conductor remains under compression thereby maintaining good molecular electrical contact.

If it is desired to remove connector 10 from openings 22 and 24 a retracting tool can be inserted in opening 32 and under U-shaped section 11 to lift out connector 10. Opening 32 is advantageous because typically the top of U-shaped portion 11 is flush with or below the top of base member 20. After connector 10 is removed from slot 22 and 24 the conductors can be easily removed from the conductor retaining openings.

The embodiment of base member 20 shown in FIG. 14 is particularly advantageous when additional wires are to be connected after some wires have already been connected by a connector. An additional connector is used which is advantageous because the first connector does not have to be moved after contact has been made with initially installed conductors. Such movement may have a tendency to destroy the quality of the electrical connection. An example of a situation when subsequent addition of wires may occur is when some of the wires are installed and connected by a connector at the factory and then there is an additional field installed wire which must be subsequently connected to the factory installed wires. Further, the double connection to those wires contacted by both the first and the second connector is advantageous because it further reduces the resistance of the path between those wires by providing additional legs through which current can flow.

More particularly, a short connector can be inserted into holes 131 and 131*a* connecting the wires placed at the factory in openings 120 and 121 and then, subsequently in the field, a long connector can be inserted in holes 132 and 132*a* making connection to wires in openings 120, 121, 122 and 123. FIG. 14 also shows how modular sections 100 can be used to construct a base member containing a plurality of conductor positioning openings and connector positioning openings. Typically, at each end of an assembled terminal strip are end modules such as 107 and 110 which have concave openings only on the interior side. The modular sections of the terminal strip can be connected by various means such as pins going through the segments connecting them together.

A particularly advantageous method of introducing connector 10 into base member 20 is with an instrument such as a staple gun. Many connections can be rapidly and easily fabricated with such an instrument. This is very desirable when numerous field installed wires must be connected to a modular base segment as discussed above.

Typical materials for connector 10 include phosphor bronze, berillium copper, tempered aluminum and other similar metals. The connector may or may not be plated with a higher conductivity material. A typical material for base member 20 is a plastic which is resistant to deformation.

Various modifications and variations will no doubt occur to those skilled in the various arts to which this invention pertains. For example, the angular relationship of a conductor and a connector may be varied. Further, base segments may be connected in a plurality of different ways so a common line runs through all of them providing a common bus connection connected by connectors to all other conductors in the base member. These and all other variations which basically rely on the teachings through which this disclosure has advanced the art are properly considered within the scope of this invention as identified by the appended claims.

The embodiments of the invention in which an exclusive property or privilege is claimed are defined as follows:

1. An electrical connector assembly adapted to be electrically conductively connected to an elongated conductor comprising:

a conductor engaging connector means including a base with two elongated legs extending from said base and spaced from each other, said legs including at least two sides thereof intersecting to form cutting edges; said combined legs in transverse cross section being defined by an outline which is elongated in shape;

a base member having a positioning means for positioning a conductor to be oriented in a first predetermined direction and for resisting movement of the conductor when the conductor engaging connector means is forced adjacent the conductor;

opening means in the base member intersecting said positioning means, the overall combined, transverse, cross-sectional shape of said opening means being defined by an outline which has an elongated shape essentially the size and shape as said outline defining the overall shape of said legs;

said elongated outline of said opening means extending longitudinally in a direction oblique to the said first predetermined direction of said positioning means whereby when said legs are pushed through said opening means the sides of said opening means engage said legs to guide and orient said cutting edges into piercing relationship with a conductor located within said positioning means and thereby providing an electrical connection between said connection means and the conductor.

2. An electrical connector assembly as recited in claim 1 wherein;

the conductor engaging connector means includes two legs, between which a conductor is to be electrically connected, said legs having opposing generally flat faces which are substantially parallel; and the opening means has a cross section shaped similarly to the cross section of the connector means and is positioned so the axis of the conductor is not parallel to the plane of the opposing generally parallel faces of the legs on opposite sides of the conductor.

3. An electrical connector assembly as recited in claim 2 wherein the conductor engaging connector means has the legs connected by an integral, generally U-shaped junction portion, the legs extending downwardly from the U-shaped junction portion, the inner facing surfaces of the legs forming a conductor-receiving channel.

4. An electrical connector assembly as recited in claim 3 wherein the conductor engaging connector means includes legs having tapered points at the end away from the U-shaped junction.

5. An electrical connector assembly as recited in claim 4 wherein the conductor engaging connector means is formed of a relatively more easily deformable material than the base member.

6. An electrical connector assembly as recited in claim 5 wherein:

the conductor engaging connector means includes two legs, each having a generally rectangular cross section, between which a conductor is to be electrically connected, the opposing generally flat faces of the legs being generally parallel.

7. An electrical connector assembly as recited in claim 6 wherein the opening means is located relative to the conductor positioning means so at least parts of two adjacent faces and the intervening corner of each leg engage a conductor located between the legs.

8. An electrical connector assembly as recited in claim 7 wherein the intervening corner of each leg is sufficiently sharp and resistant to deformation to penetrate any insulation surrounding the conductor.

9. An electrical connector assembly as recited in claim 8 wherein the perpendicular distance between the planes of the inside opposing faces of the legs is approximately equal to the width of an inside face of the legs.

10. An electrical connector assembly as recited in claim 9 wherein the conductor positioning means is a substantially symmetric opening about a plane parallel to the legs and has a longitudinal center line passing approximately through the corners of each leg engaging a conductor in the conductor positioning means.

11. An electrical connector assembly as recited in claim 10 wherein the conductor engaging connector means is formed of a bent wire stock.

12. An electrical connector assembly as recited in claim 10 wherein the conductor engaging connector means is stamped from a metal sheet.

13. An electrical connector assembly as recited in claim 10 wherein the base member has at least two conductor positioning means.

14. An electrical connector assembly as recited in claim 13 wherein the conductor positioning means are cylindrical openings.

15. An electrical connector assembly as recited in claim 13 wherein the conductor positioning means have a teardrop shaped cross section.

16. An electrical connector assembly as recited in claim 13 wherein the conductor positioning means includes an abutment preventing a conductor from passing completely through the base member.

17. An electrical connector assembly as recited in claim 13 wherein the base member includes two segments, each segment shaped to form one-half of a conductor positioning means and one-half of an opening means so adjacent placement of segments provide a complete conductor positioning means and a complete connector positioning means.

18. An electrical connector assembly as recited in claim 17 wherein a plurality of the segments are connected in a sequence to form a plurality of conductor positioning means and connector positioning means.

19. An electrical connector assembly as recited in claim 18 wherein the base member is made of plastic material.

20. An electrical connector assembly as recited in claim 19 wherein the conductor engaging connector means is made of a conducting deformable metal.

21. The assembly of claim 1 in which each of the legs have a flat surface forming with a respective intersecting side thereof the said cutting edges, said flat surfaces spaced from and opposing each other, said cutting edges being spaced and located diagonally from each other;

said flat surfaces being located on parallel planes which when said connector is located in said opening means intersect said positioning means at an oblique angle whereby when said legs are pushed through said opening means and are guided and oriented thereby the said cutting edges extend into said positioning means and thereby pierce said conductor.

22. An electrical connector assembly as recited in claim 21 wherein the base member has at least two conductor positioning means.

23. An electrical connector assembly adapted to be electrically conductively connected to at least two axially elongated conductors comprising:

a conductor engaging connector means including a base with two elongated legs extending from said base and spaced from each other, said legs being rectangular in shape whereby the sides thereof intersect to form cutting edges;

said combined legs in transverse cross section being defined by an elongated rectangular outline formed by two parallel sides extending along two of the sides of the legs and therebetween and the ends thereof formed by two parallel sides extending along the outermost sides of the legs;

a base member having first and second opening means for positioning a first and second conductor in substantially parallel directions and for resisting movement of said conductors when the conductor engaging connector means is forced adjacent the conductors;

third opening means in the base member intersecting said first and second opening means, the overall combined, transverse cross-sectional shape of said opening means being defined by an outline which has an elongated rectangular shape essentially the size and shape of said outline defining the overall shape of said legs;

said elongated outline of said third opening extending longitudinally in a direction oblique to the directions of said conductors whereby when said legs are pushed through said third opening means the sides of said third opening means engage said legs to guide and orient said cutting edges into piercing relationship with the conductor located within said positioning means and thereby providing an electrical connection between said connector means and the conductor.

24. An electrical connector assembly as recited in claim 23 wherein the conductor engaging connector means has the legs connected by an integral, generally U-shaped junction portion, the legs extending downwardly from the U-shaped junction portion, the inner facing surfaces of the legs forming a conductor-receiving channel.

25. An electrical connector assembly as recited in claim 23 wherein the conductor engaging connector means includes legs having tapered points at the end away from the U-shaped junction.

26. An electrical connector assembly as recited in claim 23 wherein the base member includes two segments, each segment shaped to form one-half of the conductor positioning means and one-half of an opening means so adjacent placement of segments provide a complete conductor positioning means and a complete connector positioning means.

27. An electrical connector assembly as recited in claim 23 wherein a plurality of the segments are connected in a sequence to form a plurality of conductor positioning means and connector positioning means.

* * * * *